United States Patent [19]

Horn

[11] 4,175,777

[45] Nov. 27, 1979

[54] BOOK INDEX AND SUBJECT FINDER

[76] Inventor: Sherrye J. Horn, 5747 W. Missouri, Sp. 89, Glendale, Ariz. 85301

[21] Appl. No.: 920,575

[22] Filed: Jun. 29, 1978

[51] Int. Cl.[2] ..... B42F 21/00

[52] U.S. Cl. ..... 283/42; 40/359; 40/594

[58] Field of Search ..... 40/359, 360, 594; 281/36–42; 283/36–42

[56] References Cited

U.S. PATENT DOCUMENTS 3,473,827 10/1969 Leadbetter ..... 283/36

*Primary Examiner*—Gerald A. Dost
*Attorney, Agent, or Firm*—Charles E. Cates

[57] ABSTRACT

The specification discloses a book index which has an index page adapted for permanent attachment to the body of a page of a selected book, color indicia carried by the page, subject identification means associated with the color indicia, transparent colored sheets keyed to the colors of the color indicia and adapted to self-adhere to the pages of the book selected for marking and to cover the pertinent subject matter desired to be marked extending to the margin of the page whereby the color indicia is visible when the book to which the sheets are applied is closed. The marking and indexing of passages of selected subject matter is done by affixing the index page to the forepart of the book, writing in the title of the subject in association with the color indicia and affixing the colored sheets to selected passages in the book and extending the colored sheets to the edge of the page whereby they are visible when the book is closed.

4 Claims, 4 Drawing Figures

BOOK INDEX AND SUBJECT FINDER

BACKGROUND OF THE INVENTION

This invention relates to improvements to book indices and subject finders.

Various means for indexing and highlighting pertinent subject matter in books have been heretofore employed. Tabs extending outwardly of the pages of the book in association with keys to the tabs are described in U.S. Pat. No. 3,473,827, Leadbetter, wherein a page is provided for affixation to a book which page carries alphabetical tabs keyed to subject matter. Marking pens and pencils have been used on the pages of books to mark and highlight subject matter that is desired to be referred to at a future time. A popular example is the soft felt pen used to mark a portion of a page desired to be highlighted.

The various devices of the prior art have been useful, but have certain problems. The tabs are unsightly and have a tendency to hide each other and to catch on each other. The soft felt pens bleed through thin pages used in many books, such as Bibles, to the opposite side of the pages marked and detracts from the legibility of the pages.

I have discovered that the difficulties of the prior art can be overcome by means of the improvements hereafter set out which comprise my invention.

BRIEF SUMMARY OF THE INVENTION

Accordingly, I provide a book index having an index page adapted for permanent attachment to a page of a book to be indexed. The page carries color indicia and subject identification means associated with the color indicia. Conveniently, the color indicia is spots of differing colors arranged vertically together with lines associated with each color upon the page and adapted to the subject to be indexed. I also provide in the index separate subject markers of transparent colored sheets whose colors are keyed to the color indicia and adapted to self-adhere to the pages of the book. They are affixed to cover subject matter desired to be marked or highlighted and extend to the margin of the page. Thus, the color indicia is visible when the book to which the indicia is applied is closed. Preferably, the subject matter markers are pre-cut in rectangular shape and supplied with the other elements of the invention, in a package, in kit form with instructions for the use of the kit to index a book of the purchaser's choice.

My method of making and indexing passages of selected subject matter in a book contemplates the steps of affixing the index page to the forepart of the book, writing in the title of the subject in association with the color indicia, and affixing appropriate colored sheets to selected passages in the book extending to the edge of the page in each case.

DETAILED DESCRIPTION OF THE PREFERRED EMBODIMENTS

Turning now to the drawings in which a presently preferred embodiment of the invention is illustrated:

Figure 1:
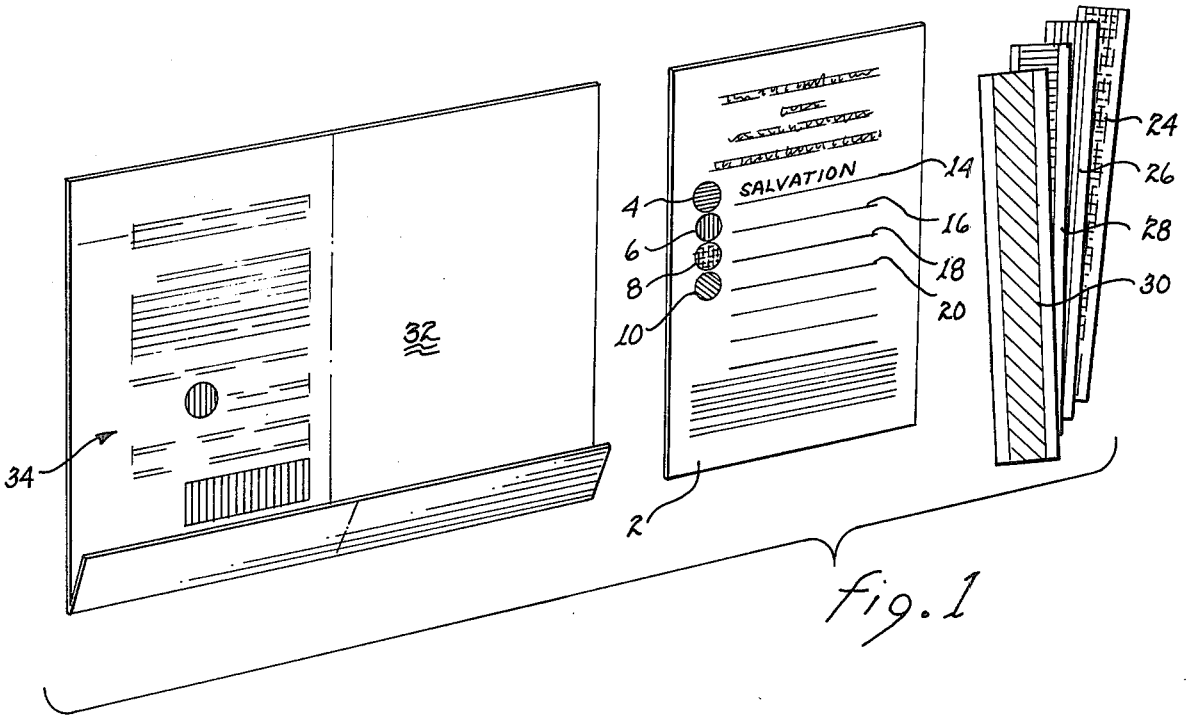
FIG. 1 is a perspective view of the various elements of a kit embodying the invention.

Referring specifically to FIG. 1 in the drawings which shows the element of the kit, the numeral 2 indicates the index page on which various color indicia 4, 6, 8, 10 appear. Lines 14, 16, 18 and 20 associated with the color indicia are provided on the page to write the desired subject indentification. Although four color indicia and lines are shown specifically, it is to be understood that any desired number of color indicia and subject identification means associated with them can be used. Separate subject markers 24, 26, 28 and 30 whose colors are keyed to the color indicia 4, 6, 8 and 10, are provided. The foregoing elements are made into kit form by packaging them in a folder 32 provided with instructions 34.

In this preferred embodiment the color keyed subject markers 24–30 are pre-cut from strips of self-adhering transparent adhesive of about 15 centimeters in length which turns out to be an ideal compromise of length for books of the most common page sizes, especially bibles. A material suitable for the subject markers may be obtained from Minnesota Mining & Milling Co., described as matte acetate (their #7701) 0.002 acetate film, acrylic adhesive (3M high tack) on forty-three pound semi-bleached kraft release backing.

Figure 2:
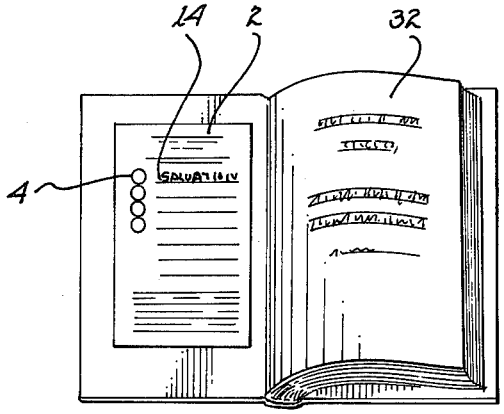
FIG. 2 is a view of a book with the index page of the invention attached to the inside cover of the book.
Figure 3:
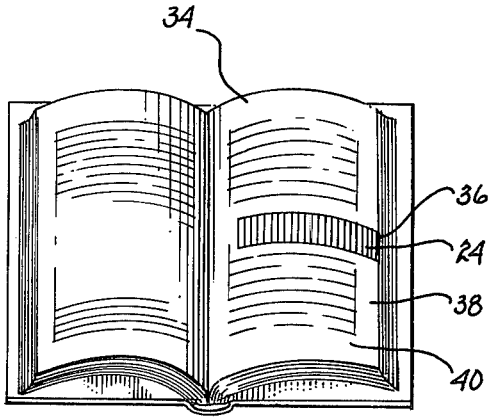
FIG. 3 is a view of the same book with the subject marker of the invention affixed over pertinent subject matter.
Figure 4:
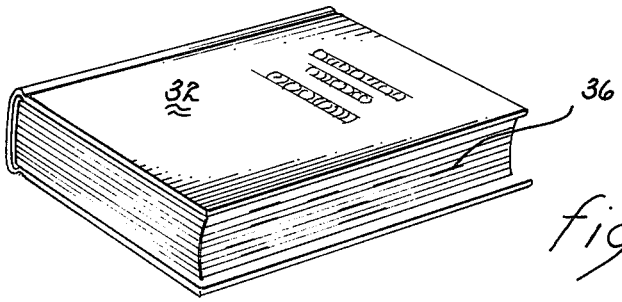
FIG. 4 is a perspective view of a book marked with the invention showing the indexing feature visible when the book is closed.

Referring now to FIG. 2, the index page 2 is shown applied to a bible 32 which has thin pages. The index page is self-adhering and permanently attached to the inside surface of the cover of the bible. As seen in FIG. 3 the self-adhering subject marker 24 corresponding to color indicia 4 covers a passage of subject matter corresponding to the subject identification 14 associated with the color indicia 4. The end 36 of the colored sheet extends to the edge 38 of the page 40 which makes it and other colored sheets similarly applied visible when the book is closed as illustrated in FIG. 4.

From a consideration of the teachings of this disclosure persons ordinarily skilled in the art will be able to select various alternative and equivalent means to perform the function of the disclosed preferred embodiment, all of which are within the spirit of this invention, as pointed out in the appended claims.

What is claimed is:

1. A book index comprising an index page adapted for permanent attachment to the body of a page of the book; color indicia carried by said page; subject identification means associated with said color indicia; separate subject markers comprising transparent colored sheets keyed to the colors of said color indicia and adapted to self-adhere to the pages of said book to cover pertinent subject matter desired to be marked and extend to the margin of said page, whereby said color indicia is visible when the book to which said sheets are applied is closed.

2. The index of claim 1 wherein the subject markers are pre-cut, rectangular and supplied with the other elements of the index in a package in kit form with instructions to the user for use in a book of the purchaser's choice.

3. The book index of claim 1 used in a method of marking and indexing passages of selected subject matter in a book comprising the steps of affixing the index page to the forepart of a book; writing in the title of the subject in association with said color indicia; and affixing said colored sheets to selected passages in the book extending to the edge of the page.

4. The index of claim 1 wherein said color indicia comprise spots of differing colors and said subject identification means comprises lines on the index page associated with said spots of colors.

* * * * *